United States Patent [19]

Boyadjieff et al.

[11] Patent Number: 4,479,547

[45] Date of Patent: Oct. 30, 1984

[54] WELL PIPE JACK

[75] Inventors: George I. Boyadjieff, Anaheim; Andrew B. Campbell, San Marino, both of Calif.

[73] Assignee: Varco International, Inc., Orange, Calif.

[21] Appl. No.: 522,547

[22] Filed: Aug. 11, 1983

Related U.S. Application Data

[63] Continuation of Ser. No. 268,763, Jun. 1, 1981, abandoned.

[51] Int. Cl.[3] ..... E21B 19/10

[52] U.S. Cl. ..... 166/383; 166/77; 166/77.5; 175/171; 254/29 R

[58] Field of Search ..... 175/22, 57, 171, 195, 175/202, 203; 166/71, 85, 77, 77.5, 379, 380, 381, 383; 405/228, 197, 199; 254/29 R

[56] References Cited

U.S. PATENT DOCUMENTS

| | | | |
|---|---|---|---|
| Re. 25,680 | 11/1964 | Brown | 254/29 R |
| 1,121,718 | 12/1914 | Derby et al. | 254/36 |
| 1,586,923 | 6/1926 | Townsend | 166/77 |
| 1,883,070 | 10/1932 | Stone | 173/149 |
| 1,904,256 | 4/1933 | Sheldon | 173/152 |
| 2,090,854 | 8/1937 | Timbs | 254/29 R |
| 2,126,933 | 8/1938 | Stone et al. | 166/77 |
| 3,257,099 | 6/1966 | Merritt, Jr. | 254/105 |
| 3,282,357 | 11/1966 | Bunn | 175/122 |
| 3,722,603 | 3/1973 | Brown | 173/159 |
| 3,722,607 | 3/1973 | Ray | 175/57 |
| 3,888,318 | 6/1975 | Brown | 173/149 |
| 3,949,883 | 4/1976 | Crooke et al. | 214/1 P |

FOREIGN PATENT DOCUMENTS

| | | |
|---|---|---|
| 1063096 | 1/1960 | Fed. Rep. of Germany . |
| 2552095 | 5/1976 | Fed. Rep. of Germany . |
| 899463 | 6/1962 | United Kingdom . |
| 1367480 | 9/1974 | United Kingdom . |
| 2071734 | 9/1981 | United Kingdom . |

OTHER PUBLICATIONS

"New Casing Tools May Eliminate Need For Super Rigs" by Abbott et al., Oil & Gas Journal–Jul. 21, 1980.

*Primary Examiner*—James A. Leppink
*Assistant Examiner*—Hoang C. Dang
*Attorney, Agent, or Firm*—William P. Green

[57] ABSTRACT

A jack for lowering casing from a drilling rig into a well, including a plurality of piston and cylinder mechanisms extending vertically at different sides of the well axis and supported at their lower ends from a base, a first structure extending between upper ends of the cylinders of those mechanisms and supported from the base through the cylinders, a second structure supported by and movable with the pistons, and gripping units carried by the two structures and releasably engageable with the casing to lower it in steps by relative vertical actuation of the two structures by the piston and cylinder mechanisms.

9 Claims, 11 Drawing Figures

WELL PIPE JACK

This application is a continuation of application Ser. No. 6/268,763, filed June 1, 1981, now abandoned.

BACKGROUND OF THE INVENTION

This invention relates to improved jacking mechanisms for lowering casing or other pipe into a well.

In our prior copending application Ser. No. 6/169,718 entitled "Well Casing Jack Mechanism", we have disclosed a casing jack which is adapted to be positioned in a well drilling rig and which can be utilized for lowering a string of casing into a well drilled by the rig. The jack is especially desirable for use in connection with deep wells in which the casing string may be too heavy to be suspended and lowered by the traveling block and other conventional equipment of the rig. The jack of that prior application may be positioned in the rig at essentially the location at which the rotary table is mounted during drilling, and preferably includes piston and cylinder mechanisms at different sides of the well axis for relatively vertically actuating two gripping units to progressively lower the casing.

SUMMARY OF THE INVENTION

The present invention provides improvements in a jack of the above discussed general type, and in particular is in certain respects especially concerned with the manner in which the load forces exerted by the weight of the string being lowered are transmitted to the ground at the rig location with minimum structure and preferably without applying those forces to the rig framework itself. These results are achieved in large part by utilization of the cylinders of the piston and cylinder mechanisms which power the jack as load supporting members for transmitting the load forces to a ground supported base. These cylinders extend vertically at different sides of the well axis, preferably at diametrically opposite locations with respect to that axis, and have lower portions which are supported on the base. A first pipe gripping structure is supported by upper portions of the power cylinders in a relation transmitting load forces from that gripping structure downwardly through the cylinders, and thus supporting the gripping structure from the base directly through those cylinders. The pistons associated with the cylinders have rods projecting upwardly beyond the cylinders with a second pipe gripping structure being supported by the pistons, and with gripping means being carried by both of the two upper structures for releasably gripping, supporting and lowering the casing. In assembling the jack, the two cylinders may be inserted through openings in a locating template, which then functions to retain the cylinders in a predetermined spaced relation.

BRIEF DESCRIPTION OF THE DRAWINGS

The above and other features and objects of the invention will be better understood from the following detailed description of the typical embodiment illustrated in the accompanying drawings in which.

DESCRIPTION OF THE PREFERRED EMBODIMENT

Figure 2:
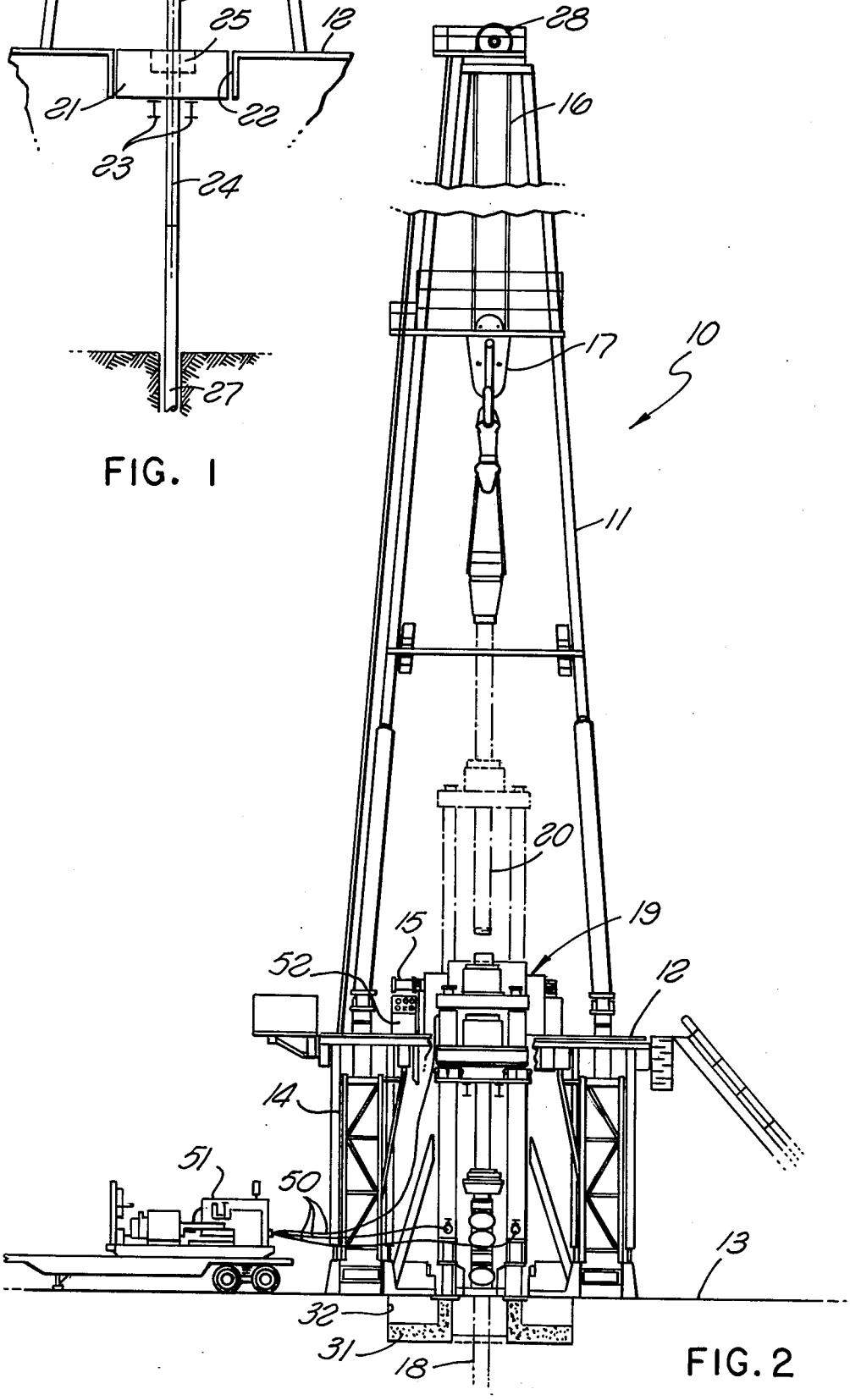
FIG. 2 shows the rig of FIG. 1 with the rotary table removed and a jack embodying the present invention positioned in the rig.

In FIG. 2, there is represented at 10 a well drilling rig having a framework structure which includes an upwardly projecting mast or derrick 11, a horizontal rig floor 12 at the lower end of the derrick and spaced above ground level 13, and a substructure 14 supporting the floor and mast. The draw works 15 acts through a line 16 to raise and lower a traveling block 17 for suspending the drill string and other equipment in the well. FIG. 2 shows the rig after completion of the actual drilling of a well 18 into the earth, and with a jack 19 embodying the present invention positioned in the rig for lowering a string of casing 20 into the well.

Figure 1:
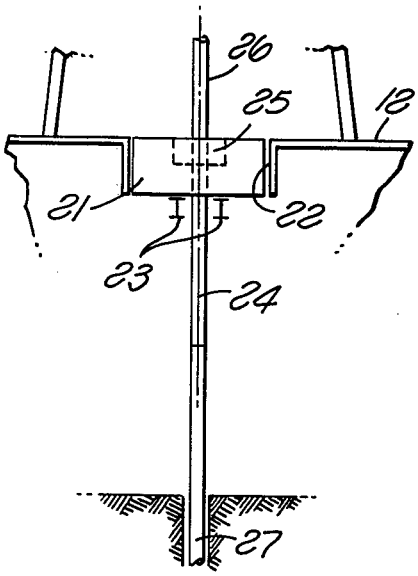
FIG. 1 is a fragmentary diagrammatic representation of a drilling rig during a well drilling operation.

FIG. 1 shows the rig during the drilling operation, at which time a conventional rotary table 21 is positioned within a central recess or opening 22 in the rig floor 12, being supported on a pair of parallel beams 23 extending across the underside of recess 22. Beams 23 may be identical I beams as shown, and be positioned at opposite sides of the vertical axis 24 of the rig and well, and be connected to the substructure 14 of the rig at opposite ends of the beams. Rotary table 21 acts through the usual master bushing and kelly bushing diagrammatically represented at 25 to drive a non-circular kelly 26 and connected drill pipe 27 rotatively about axis 24 to drill the well.

The jack 19 may have a load handling capacity which is well in excess of the capacity of the rig framework structure, including mast 11 and substructure 14, and the draw works and actuated line 16, crown block 28, traveling block 17, and other related equipment. For example, the draw works, rig framework, and related equipment for suspending drill string 27 may be capable of supporting and driving a drill string up to a weight of but not exceeding 500 tons. It is assumed that this load capacity is entirely adequate for supporting the drill string to a desired depth, but cannot support the greater weight of the string of casing 20 required to line a hole of that same depth. The jack 19, therefore, has a load supporting capacity substantially greater than the draw works, etc., say for example up to 1,000 tons, to thus adapt the rig for lowering the very heavy casing without the necessity for using a heavier capacity rig during the drilling operation.

Figure 3:
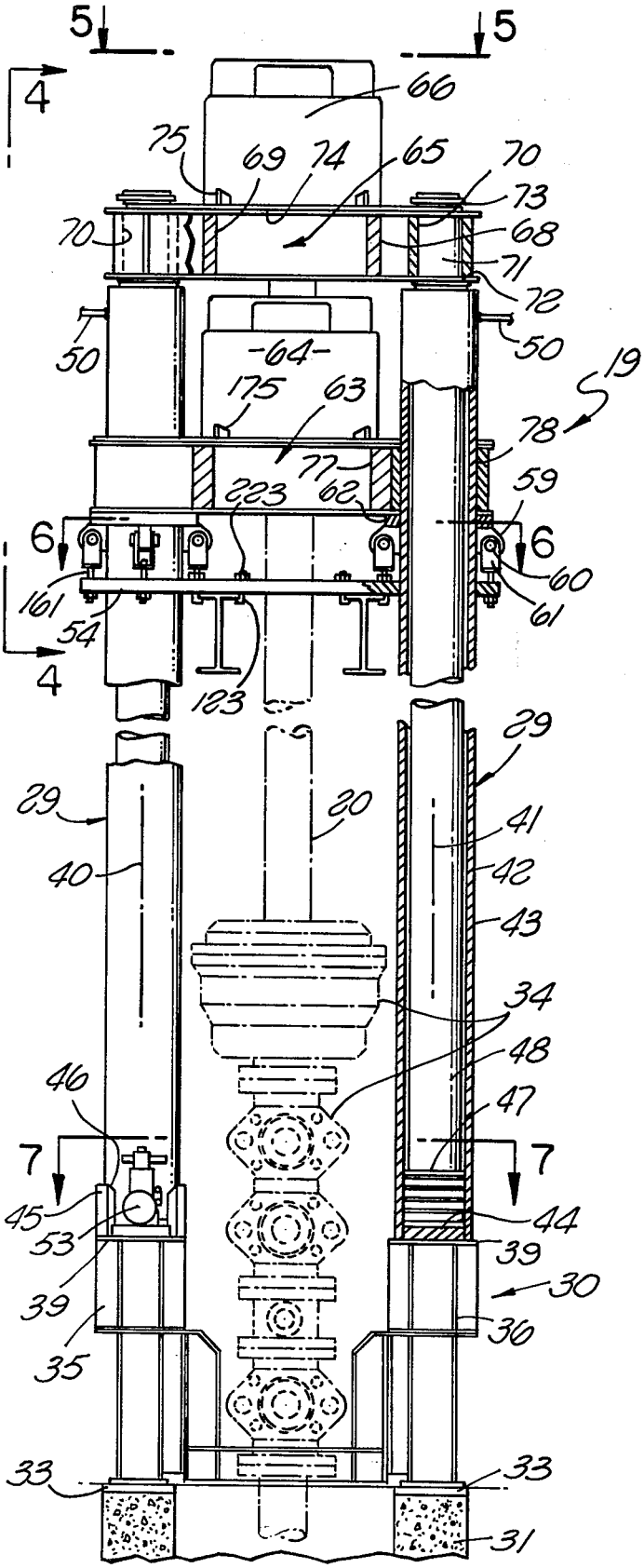
FIG. 3 is an enlarged fragmentary view, partially in section, of the jack of FIG. 2.

Referring now to FIG. 3, jack 19 includes two typically identical piston and cylinder mechanisms 29 supported from their lower ends on a base 30 which is in turn supported from the ground. To assist in taking the heavy loads of the casing string, a concrete foundation 31 may be formed in a cellar or recess 32 in the ground, with two horizontal metal plates 33 positioned on the upper surface of the foundation at ground level to engage and support base 30. Casing 20 extends downwardly between the two piston and cylinder mechanisms 29, and through blowout preventers 34 connected to the top of the well.

Base 30 preferably takes the form of a rigid structure fabricated from a number of metal parts suitably bolted or otherwise secured together and forming two similar upwardly projecting portions 35 and 36 at opposite sides of the casing and well axis, with these portions 35 and 36 being rigidly connected together by portions 37 and 38 (FIG. 7) located just above ground level and low enough to be received beneath laterally projecting portions 40' of the lowermost blowout preventer. The upper extremities of upwardly projecting portions 35 and 36 of base 30 may take the form of horizontal metal plates 39 on which cylinders 29 rest.

Figure 7:
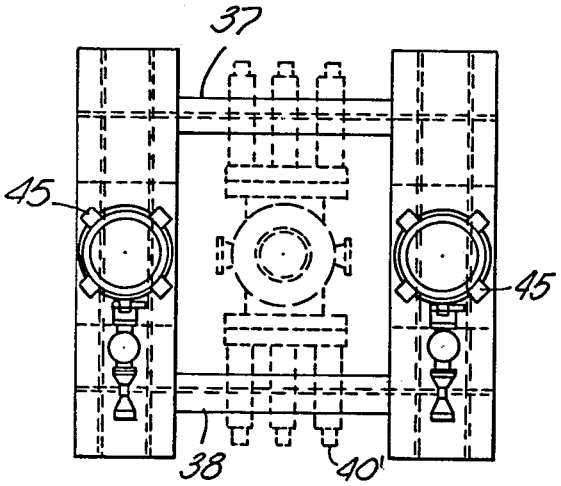

The two piston and cylinder mechanisms 29 may be identical, and extend vertically along two parallel vertical axes 40 and 41 which are parallel to and at diametrically opposite sides of and spaced equal distances from the main vertical axis 24 of the rig and well. The cylinder 42 of each of the piston and cylinder mechanisms 29 has a tubular sidewall 43 which may be internally and externally cylindrical about axis 40 or 41, and which is closed at its lower end by a horizontal bottom wall 44 engaging and appropriately welded or otherwise secured to side wall 42 and resting on the upper surface of the corresponding top plate 39 of base 30. The lower end of the cylinder may be retained against horizontal movement from a desired position on the base structure by a number of locating lugs or fingers 45 welded to and projecting upwardly from plate 39 at locations to engage the outer surface of the cylinder at circularly spaced locations and form a socket structure into which the cylinder is insertable downwardly in locating relation. As seen in FIG. 7, four such lugs 45 may be provided at equally spaced locations about each of the cylinders. The upper ends of these lugs 45 may have camming surfaces 46 which are inclined to advance downwardly as they advance radially inwardly toward axis 40 or 41 to deflect the cylinder to a centered position as it moves downwardly within the socket structure.

The piston 47 of each of the piston and cylinder mechanisms slidably engages the cylinder and is reciprocable upwardly and downwardly along axis 40 or 41 relative thereto, and has a piston rod 48 projecting upwardly through the upper extremity 49 of the cylinder in sealed relation. Pressurized hydraulic fluid is delivered selectively to either the upper ends of the cylinders or their lower ends through lines represented diagrammatically at 50, from a pressure fluid source 51, under the control of an operator on rig floor 12 through actuation of control elements on a panel 52, typically acting through an appropriate pilot valve assembly. Discharge of pressure fluid from the lower ends of the cylinders and admission of pressure fluid to their upper ends causes downward movement of the pistons relative to the cylinders, while reverse connection of the fluid lines actuates the pistons upwardly. During downward movement, the discharge of fluid from beneath the pistons is preferably regulatable to different rates by varying the extent to which two adjustable choke valves 53 are opened, to thus afford a precise and reliable control of the rate at which casing 20 is lowered by the jack.

Figure 6:
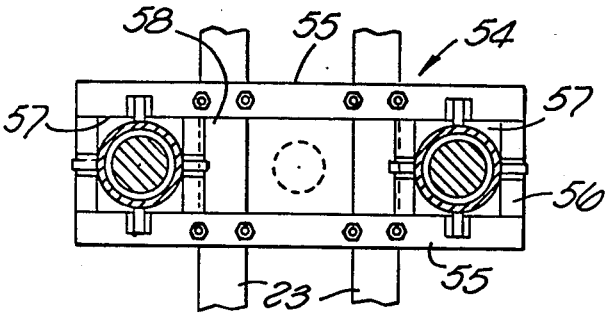
FIGS. 6 and 7 are horizontal sections taken on lines 6—6 and 7—7 respectively of FIG. 3.

The upper ends of cylinders 42 are located in the desired spaced relationship relative to one another by insertion downwardly through a cylinder positioning and anchoring frame or template 54, which may be essentially flat and fabricated of sheet metal parts appropriately welded or otherwise secured together as illustrated in FIGS. 3 and 6. This frame 54 may include two similar spaced parallel rigid sheet metal strips 55 joined rigidly together by transverse connectors 56 to form two spaced typically square openings 57 dimensioned to closely receive cylinders 42 and hold their axes 40 and 41 in the proper spaced relation. Intermediate these two openings 57, the frame or template 54 contains a typically rectangular central opening 58 dimensioned to allow extension of the casing 20 downwardly therethrough. Before insertion of piston and cylinder mechanisms 29 downwardly through central opening 22 in the rig floor, frame 54 is placed on the upper surfaces of the two horizontal flanges of rotary table supporting beams 23, to allow the piston and cylinder mechanisms to be inserted downwardly through openings 57.

Above the level of locating template 54, cylinders 42 carry on their outer surfaces a number of evenly circularly spaced connector brackets or eye lugs 59 to which there are pivotally connected by horizontal pins 60 a number of typically U-shaped links 61. Screws 161 extend vertically through openings in links 61 and template 54 and may have heads bearing downwardly against the links and nuts bearing upwardly against the template to retain the cylinders against upward movement relative to the template. The cylinders are, however, free to settle slightly downwardly relative to the template by virtue of the illustrated vertical spacing between links 61 and the template and since the screws upon such settling movement can move downwardly relative to the template and within the openings in the template through which the screws extend.

The template may be held in fixed position by attachment to beams 23, as by a number of L-shaped clamps or fasteners 123 extending through openings in template 54 and having lower ends turned beneath the beam flanges, with clamps 123 being tightened against those flanges by threaded connection of nuts 223 onto upper ends of elements 123.

Figure 4:
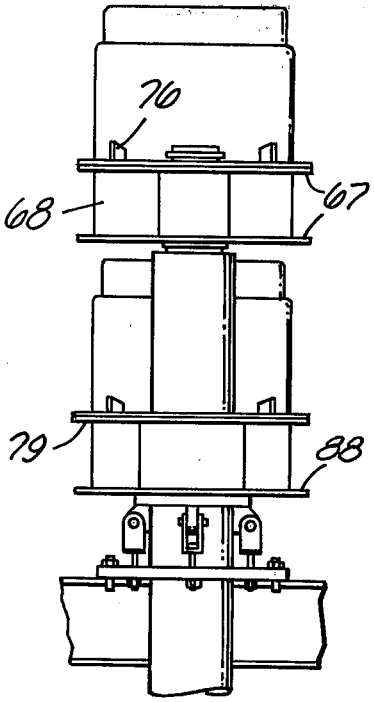
FIG. 4 is a fragmentary side view taken on line 4—4 of FIG. 3.
Figure 5:
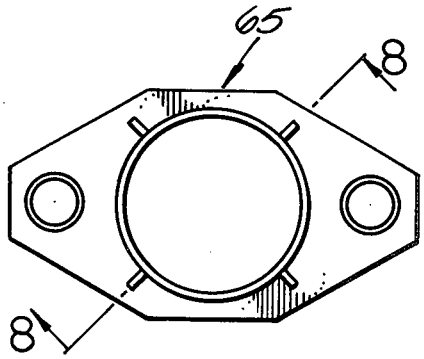
FIG. 5 is a top plan view taken on line 5—5 of FIG. 3.

Just above the connector lugs 59, each of the cylinders carries an annular flange 62, which may be formed as a rigid ring of metal or the like welded to the outside of the cylinder. Above flanges 62, the two cylinders 42 carry and support a first transverse upper structure 63 on which a first casing gripping unit 64 is carried. The upper ends of piston rods 48 similarly carry and support, and also actuate vertically, a second upper support structure 65 on which a second gripping unit 66 is carried. Structure 65 may typically have the plan view outline configuration illustrated in FIG. 5, and as seen in FIG. 4 may include upper and lower horizontal rigid metal plates 67 secured together by vertically extending members 68 configured to form a relatively large central vertical opening 69 through unit 65 and centered about axis 24, and two smaller openings 70 at opposite sides of opening 69 and centered about axes 40 and 41 of the cylinders. Openings 70 are dimensioned to exactly receive and closely confine the reduced diameter ends 71 of piston rods 48, with upwardly facing annular shoulders 72 on the piston rods engaging upwardly against bottom plate 67 of unit 65 to support the latter from the piston rods. Snap rings 73 received within grooves in the upper extremities of the piston rods may engage the upper plate 67 about openings 70 to lock unit 65 on the piston rods for upward and downward movement therewith. Gripping unit 66 has a horizontal undersurface 74 engaging the upper horizontal surface of the top plate 67 of support structure 65, with unit 66 being centered with respect to axis 24 by reception between a number of evenly circularly spaced locating lugs 75 (typically four such lugs) secured to top plate 67 and preferably having upper camming surfaces 76 inclined to advance downwardly as they advance radially inwardly to center unit 66 on support structure 65.

The cylinder mounted support structure 63 may be constructed essentially the same as the above discussed structure 65, having a central relatively large opening 77 and two smaller openings 78 at diametrically opposite locations, but with these openings 78 being sufficiently larger than the corresponding openings 70 of upper structure 65 to exactly receive and closely confine cylinders 42 in locating relation. Gripping unit 64 may be received on the upper surface of top horizontal plate 79 of structure 63, and be centered and located thereon by lugs 175 corresponding to the discussed lugs 75 of structure 65.

Figure 8:
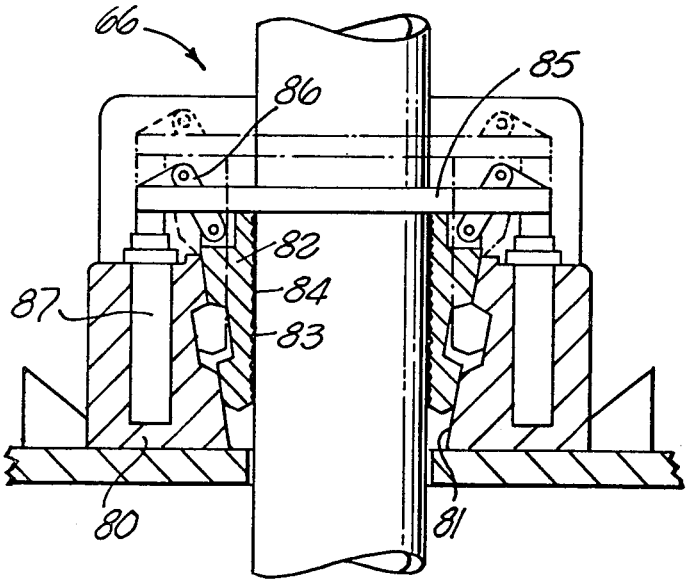
FIG. 8 is a somewhat diagrammatic vertical section through one of the slip type gripping units taken on line 8—8 of FIG. 5.

The two gripping units 64 and 66 may be identical and of a known type having wedge slips for releasably gripping and supporting the casing. The upper of these gripping units 66 is illustrated somewhat diagrammatically in FIG. 8, as including an outer annular rigid body 80 having inner downwardly tapering slip bowl surfaces 81 engageable with wedge slips 82 to cam them inwardly into gripping engagement with the casing upon downward movement of the slips relative to body 80. The inner surfaces 83 of the slips are formed to have gripping dies or teeth 84 shaped to bite into the casing surface and effectively support it. The slips are suspended by a ring 85, to which the slips are connected by links 86 allowing radially inward and outward movement as the slips are actuated upwardly and downwardly, with such upward and downward actuation being effected by a number of circularly spaced piston and cylinder mechanisms 87 having their cylinders connected to body 80 and their pistons connected to ring 85. As will be understood, when the slips are in their full line active positions of FIG. 8, the casing is supported by the gripping unit, but when the slips are actuated to their upper broken line retracted positions of FIG. 8 the casing is free for movement downwardly relative to the slips.

Figure 9:
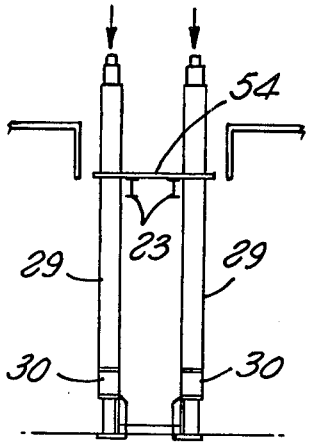
FIGS. 9, 10 and 11 are diagrammatic views representing different steps during assembly of the jack on the rig.
Figure 10:
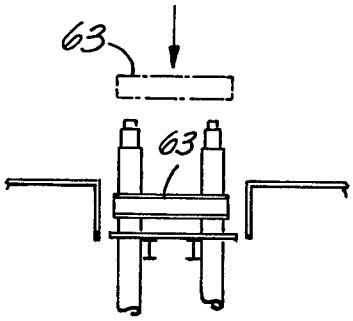
Figure 11:
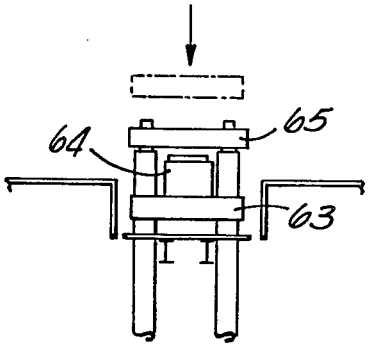

To recapitulate briefly a cycle of operation of the illustrated equipment, assume that the rig is first in the condition of FIG. 1, with rotary table 21 positioned within recess 22 in rig floor 12, and with the rotary table acting to turn kelly 26 and the connected drill string while the string is suspended and gradually lowered by traveling block 17 under the control of draw works 15. The rig framework, draw works, traveling block, line 16, etc., may typically have a maximum load handling capacity of 500 tons, and the entire weight of the drill string at maximum hole depth may be safely within that limit. If the casing to be lowered into the hole is beyond that limit, rotary table 21 is removed from the rig, and jack 19 is positioned in the rig as illustrated in FIG. 2, with that jack typically having a capacity up to 1,000 tons and adequate to support the very heavy casing. FIGS. 9 through 11 illustrate diagrammatically several steps which may be followed in assembling the jack in the rig. A first such step is to position the cylinder locating frame or template 54 in the rig, by lowering template 54 downwardly into recess 22 in the rig floor to a position of support on the upper surfaces of beams 23, as seen in FIG. 9, and by then attaching the template to beams 23 by elements 123. After such positioning and anchoring of template 54, the two piston and cylinder mechanisms 29 are lowered downwardly from above the level of the rig floor and along axes 40 and 41 respectively through openings 57 of the locating frame or template 54 and to positions of support on base 30, with the lower ends of the cylinders received within the socket structures formed by lugs 45. This inserted position of the piston and cylinder mechanisms is illustrated in FIG. 9.

The next step is to lower the first of the upper support structures 63 downwardly relative to the piston and cylinder mechanisms, from the broken line position of FIG. 10 to the full line position of that figure in which the cylinders are received within openings 78 in structure 63, and the undersurface of bottom plate 88 of structure 63 annularly engages the upper horizontal surfaces of flanges 62 about openings 78 to effectively support structure 63 through cylinders 42. Gripping unit 64 may then be positioned on structure 63, and the second of the upper support structures 65 may then be moved downwardly from the broken line position of FIG. 11 to the full line position of that figure, in which the upper ends of the piston rods are received within openings 70 in structure 65 and that structure is effectively supported and vertically actuable by the piston rods and retained thereon by rings 73. The upper gripping unit 66 may then be placed on structure 65 to place the jack in condition for operation.

Each length or section of casing 20 may be lowered by traveling block 17 along axis 24, as illustrated in FIG. 2, to a position for connection to the remainder of the casing string suspended in the well. During such lowering of a length of casing pipe, the casing string already in the well is gripped by gripping unit 64, and the casing section to be added is moved downwardly through the upper gripping unit 66 as seen in FIG. 2 and appropriately connected to the upper end of the suspended string. During or after such connection of a casing section to the string, the piston and cylinder mechanisms 29 may be actuated to raise their pistons and upper support unit 65 and the carried upper gripping unit 66 to the broken line position of FIG. 2, with the slips of that gripping unit in released condition, following which those slips may be actuated to cause unit 66 to effectively grip and support the casing string. Lower gripping unit 64 may then be released, by upward actuation of its slips, to free the casing string for downward movement under the control of jack 19. Such downward movement is effected by actuating the valve controls on panel 52 to cause discharge of pressure fluid from the lower ends of cylinders 42 and admission of pressure fluid to the upper ends of those cylinders, with the discharge from the lower ends being regulated by choke valves 53 to lower the pistons and connected parts at a controlled variable rate of speed satisfying the operating conditions which are encountered. After the upper gripping unit 66 and its support structure 65 have been lowered to the full line position of FIG. 2, the slips of the lowering gripping unit 64 are actuated to again support the string while the slips of the upper unit are released to enable that unit to be returned upwardly to the broken line position for repetition of the lowering operation. The casing may thus be progressively lowered in steps by repeated upward and downward movement of gripping unit 66 and structure 65, with the casing string being suspended by unit 64 during upward movement of unit 66 and by unit 66 during its downward movement.

When during the jacking operation the weight of the casing string is suspended by gripping unit 64, the entire load of the string is transmitted downwardly from unit 64 and its support structure 63 through the side walls 43 of cylinders 42 of the piston and cylinder mechanisms 29, to the supporting base 30 and the underlying concrete foundation and the earth. When the upper gripping unit 66 is supporting the string, the load forces are similarly transmitted downwardly through the piston and cylinder mechanism.

While a certain specific embodiment of the present invention has been disclosed as typical, the invention is of course not limited to this particular form, but rather is applicable broadly to all such variations as fall within the scope of the appended claims.

We claim:

1. The method that comprises:

drilling a well utilizing a rig having a mast and a rig floor in predetermined drilling positions in which the mast projects upwardly above the well and the rig floor extends generally horizontally near the lower end of the mast, and utilizing a drill string suspended by said mast and extending downwardly along a predetermined axis relative to said mast and through said rig floor and into the well;

removing said drill string from the rig after completion of the drilling operation;

then lowering along said axis and into the well, while said mast and rig floor remain in said drilling positions thereof above the well, a string of casing which, during at least a portion of the casing lowering operation, has a weight greater than the load supporting capacity of said mast used in drilling;

effecting the downward movement of said casing string, during at least said portion of the casing lowering operation when the weight of the string exceeds the capacity of the mast, and while said mast and rig floor both remain in said drilling positions thereof, by actuating a first casing supporting unit of a jacking mechanism which is accessible from above said rig floor used in drilling upwardly and downwardly relative to a second casing supporting unit of the jacking mechanism which is accessible from above said rig floor by means of a plurality of fluid pressure operated piston and cylinder mechanisms projecting downwardly beneath the level of said rig floor, with the casing string being supported alternately by the two units respectively;

transmitting load forces resulting from the weight of said casing string from each of said supporting units downwardly through said piston and cylinder mechanisms to a location spaced beneath said rig floor and to the earth at that location without transmission of said forces through said mast, but while said mast and rig floor used in drilling remain in said drilling positions thereof above the well; and suspending additional sections of casing from said mast as they are added to said casing string.

2. The method as recited in claim 1, including installing at least a portion of said jacking mechanism in the rig after completion of said drilling operation.

3. The method as recited in claim 1, including installing said two casing supporting units and said piston and cylinder mechanisms in the rig after completion of said drilling operation.

4. The method as recited in claim 1, in which said load forces are transmitted downwardly through tubular vertically extending side walls of the cylinders of said piston and cylinder mechanisms from an upper location at which said first unit is supported by said side walls to said location spaced beneath the rig floor at which said cylinder side walls are supported by the earth.

5. The method that comprises:

drilling a well utilizing a rig having a mast projecting upwardly above the well in a predetermined drilling position and having a rig floor, and utilizing a drill string suspended by said mast and extending downwardly along a predetermined axis relative to said mast and through said rig floor and into the well and driven rotatively by a rotary table;

removing said drill string and rotary table from the rig after completion of the drilling operation;

then lowering along said axis and into the well, while said mast remains in said drilling position above the well, a string of casing which, during at least a portion of the casing lowering operation, has a weight greater than the load supporting capacity of said mast used in drilling;

effecting the downward movement of said casing string, during at least said portion of the casing lowering operation when the weight of the string exceeds the capacity of the mast, by actuating a first casing supporting unit of a jacking mechanism which is accessible from above the rig floor upwardly and downwardly relative to a second casing supporting unit of the jacking mechanism which is accessible from above the rig floor by means of a plurality of fluid pressure operated piston and cylinder mechanisms projecting downwardly beneath the level of the rig floor, with the casing string being supported alternately by the two units respectively;

transmitting load forces resulting from the weight of said casing string from each of said supporting units downwardly through said piston and cylinder mechanisms to a location spaced beneath the rig floor and to the earth at that location without transmission of said forces through said mast, but while said mast used in drilling remains in said drilling position above the well; and suspending additional sections of casing from said mast as they are added to said casing string;

said method including installing at least a portion of said jacking mechanism in the rig after removal of the rotary table therefrom and at approximately the location at which the rotary table had been during drilling.

6. The method as recited in claim 5, including installing said two casing supporting units and said piston and cylinder mechanisms in the rig after completion of said drilling operation.

7. The method as recited in claim 5, in which said load forces are transmitted downwardly through tubular vertically extending side walls of the cylinders of said piston and cylinder mechanisms from an upper location at which said first unit is supported by said side walls to said location spaced beneath the rig floor at which said cylinder side walls are supported by the earth.

8. The method that comprises:

drilling a well bore utilizing a drill string driven rotatively about an axis by a rotary table mounted at a predetermined active position in a rig;

removing said rotary table from said active position in the rig after the well bore has been drilled;

positioning in said rig used in drilling, after removal of the rotary table therefrom, upper and lower casing supporting assemblies each carrying slip means adapted to releasably support a casing string, with said lower assembly being located at approximately said active position of the rotary table in said rig and said upper assembly being located above said active position of the rotary table;

at some point during said method positioning in said rig at different sides of said axis a plurality of fluid operated piston and cylinder units which project downwardly to a level substantially lower than said active position of the rotary table and are connected operatively to said upper casing supporting assembly to actuate it upwardly and downwardly relative to said lower assembly;

lowering a casing string heavier than said drill string into the well bore by upward and downward actuation of said upper assembly by said piston and cylinder units relative to said lower assembly while gripping the casing string alternately by said two assemblies; and transmitting load forces resulting from the weight of said casing string downwardly through said piston and cylinder units to a location spaced beneath both of said casing supporting assemblies and to the earth at that location.

9. The method as recited in claim 8, in which said rig includes a rig floor containing an opening within which said rotary table is received in said active position thereof, and includes a beam structure on which the rotary table is supported in said predetermined active position thereof, said step of positioning the upper and lower casing supporting assemblies including locating said lower assembly within said opening and above and closely adjacent said beam structure, and said step of positioning said piston and cylinder units including locating them in positions of extension downwardly beneath said floor and said beam structure.

* * * * *